United States Patent [19]

Geczy

[11] Patent Number: 4,632,193

[45] Date of Patent: Dec. 30, 1986

[54] IN-HOLE MOTOR WITH BIT CLUTCH AND CIRCULATION SUB

[75] Inventor: Bela Geczy, Glendale, Calif.

[73] Assignee: Smith International, Inc., Newport Beach, Calif.

[21] Appl. No.: 55,690

[22] Filed: Jul. 6, 1979

[51] Int. Cl.[4] ..... E21B 4/02

[52] U.S. Cl. ..... 175/65; 166/301; 166/237; 175/107; 175/317

[58] Field of Search ..... 175/107, 106, 39, 65, 175/317, 101; 166/301, 237, 240

[56] References Cited

U.S. PATENT DOCUMENTS

| | | | |
|---|---|---|---|
| 2,167,019 | 7/1939 | Yost | 175/107 |
| 3,365,007 | 1/1968 | Skipper | 175/317 X |
| 3,989,114 | 11/1976 | Tschirky et al. | 175/107 |
| 4,232,751 | 11/1980 | Trzeciak | 175/101 |
| 4,298,077 | 11/1981 | Emery | 175/107 |

FOREIGN PATENT DOCUMENTS

| | | | |
|---|---|---|---|
| 39557 | 11/1973 | U.S.S.R. | 175/107 |

*Primary Examiner*—Stephen J. Novosad
*Attorney, Agent, or Firm*—Price, Gess & Ubell

[57] ABSTRACT

An in-hole fluid motor has a clutch engageable between the motor housing and the motor shaft to connect the housing and shaft for mutual rotation upon rotation of a running-in pipe string, and a circulation valve is installed above the motor to be opened to allow circulation from the pipe string into the bore hole annulus. Circulation is maintained through the bore hole annulus during efforts to release a stuck drill bit.

6 Claims, 10 Drawing Figures

IN-HOLE MOTOR WITH BIT CLUTCH AND CIRCULATION SUB

BACKGROUND OF THE INVENTION

In the drilling of bore holes into or through earth formation, such as, for example, in the drilling of oil or gas wells utilizing a rotary drill bit, it may occur, from time to time, that the bit may be stuck in the earth formation or debris in the bore hole, for example, either due to the caving in of the bore hole wall, or due to the formation of a key seat in the hard earth formation. When the bit is stuck, under such circumstances, it is difficult, if not impossible, to pull the drill string and bit from the bore hole. In the case that the bit is stuck, moreover, the circulation of drilling fluid downwardly through ports usually provided in the drill bit may be impeded or prevented, or may be undesirable.

The circulation of drilling fluid down the running pipe string or the drill pipe string may be impeded because of the caving in of the bore hole wall forming a blockage to the upward flow of fluid from the bit through the bore hole annulus. In the case of in-hole motors, when the stuck bit stalls the motor, the flow of drilling fluid is impeded by the resistance to flow through the in-hole motor assembly. This is particularly true in the case of in-hole motors of the positive displacement type. In addition, if fluid circulation is forced through the stalled motor, the stator of the motor may be damaged or, for example, the elastomeric material of a progressive cavity motor or the turbine elements of a turbine may be washed out by the erosive action of the drilling fluid.

If circulation is interrupted for any significant period of time, the cuttings which are entrained in the drilling fluid in the annulus tend to settle out at the bottom of the bore hole, further aggravating the stuck bit problem.

It is desirable when a bit becomes stuck in a well bore against retrieval from the well bore, either in the case of the usual rotary drilling procedures or in the drilling procedures utilizing in-hole motor drills, that the running pipe string and bit be rotated, while efforts are made to pull the stuck bit free. However, in the case of the typical in-hole motors, rotation of the running pipe string cannot impart rotation to a stuck bit, since there is no positive drive connection between the motor housing and the bit drive shaft.

Circulation valves are known, as shown in Tschirky and Crase U.S. Pat. No. 3,989,114 and in Emery application, Ser. No. 06/047,296, filed June 11, 1979 now U.S. Pat. No. 4,298,077. Such valves have the advantage that the fluid can be circulated througn the open valve, upwardly in the bore hole annulus, to flush cuttings or build up filter cake on the earth formation without necessitating that the fluid pass through the in-hole motor. This saves pump horsepower and wear and tear on the motor and bearings.

SUMMARY OF THE INVENTION

It is one of the objects of my invention that when an in-hole motor drill is connected to a running pipe string to drive the drill bit, and the bit is stuck in the hole, to convert the pipe string and motor drill assembly into an assembly enabling the drill bit to be rotated by rotation of the pipe string. The converted drilling assembly can then be operated in the manner which has been found useful in freeing a stuck bit in conventional rotary drilling procedures. In addition, my invention provides for circulation of drilling fluid through the annulus while efforts are made to free the stuck bit.

To accomplish this function, I provide a circulation valve, which can be opened when the motor cannot turn the bit because the bit is stuck, and a clutch structure which engages the bit with the running pipe for mutual rotation and thrust transmission. This combination enables the continued circulation of drilling fluid while torsional efforts are applied to the motor shaft to free the stuck bit. That is, the system of my invention converts the in-hole motor assembly into one to which the usual procedure employed in rotary drilling can be applied, and also provides for circulation in the annulus, as the drill string is manipulated. This reference to usual rotary drilling procedures relates to drilling with a drill pipe having a bit secured to the lower end of the pipe and rotated by a rotary table of the drilling rig, as is well known.

The efforts to extract the stuck bit may include the application of upward or downward forces on the stuck bit, while the bit is being rotated in response to rotation of the running pipe string and while circulation of the drilling fluid is continued through the circulation valve, by passing the in-hole motor to prevent cuttings and debris from settling in the annulus, further aggravating the stuck bit problem.

In my preferred embodiments, specifically illustrated herein, the circulation valve is like that disclosed in the copending application of Emery, Ser. No. 06/047,296, filed June 11, 1979, now U.S. Pat. No. 4,298,077, associated with the clutch described in my copending applications Ser. No. 055,373, filed July 6, 1979, now U.S. Pat. No. 4,299,296 and Ser. No. 067,882 filed Aug. 20, 1979, now U.S. Pat. No. 4,253,532.

The preferred combination of bit clutch and circulation valve, is one wherein the bit clutch is hydraulically disengaged, and is automatically engaged when the circulation of drilling fluid through the bit is reduced. The circulation valve is normally closed during normal drilling operations. In such operations, drilling fluid circulates through the motor drill. In the invention of this application, the valve can be opened in response to a reduction in circulation of fluid with the valve closed and the resumption of circulation of fluid through the opened circulation valve. Upon circulation through the open valve, the clutch is automatically engaged in response to the cessation of the flow of drilling fluid through the motor.

This invention possesses many other advantages, and has other objects which may be made more clearly apparent from a consideration of several forms in which it may be embodied. Such forms are shown in the drawings accompanying and forming part of the present specification. These forms will now be described in detail for the purpose of illustrating the general principals of the invention; bit it is to be understood that such detailed description is not to be taken in a limiting sense.

DESCRIPTION OF THE PREFERRED EMBODIMENTS

Figure 1:
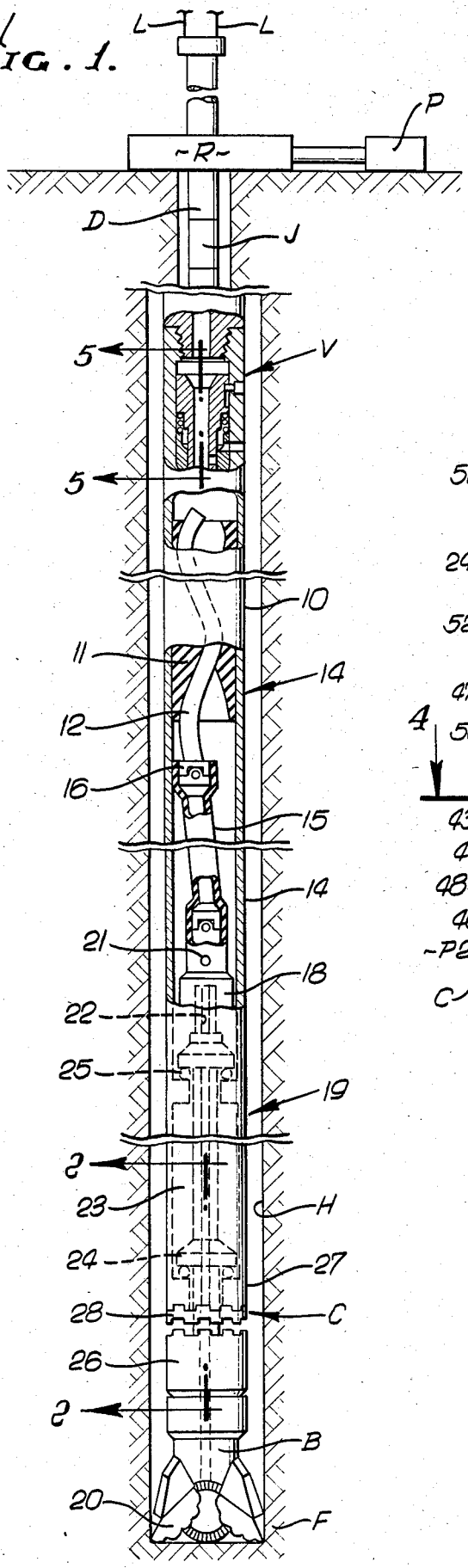
FIG. 1 is a view diagramatically showing an in-hole motor drill, partly in elevation and partly in section, in an earth bore hole, said incorporating clutch and circulating valve structure in accordance with the invention.

As seen in the drawings, referring first to FIG. 1, an in-hole motor assembly M is connected to the lower end of a string of drilling fluid conducting drill pipe D and has its housing 10 providing a progressing cavity stator 11 for a rotatable helicoidal rotor 12. The illustrative motor is a positive displacement-type fluid motor of a known type. The rotor is driven by a downward flow of fluid supplied to the pipe string from the usual pump P provided on a drilling rig having a rotary R which can rotate the pipe D which is suspended by the usual drilling lines L of a derrick or rig (not shown). The fluid passes downwardly from the pipe string D, through a jar J and a circulating valve V and through a connecting rod housing section 14 which contains a connecting rod assembly 15, connected by a universal joint 16 to the lower end of the rotor 12 and by a universal joint 17 to the upper end of the drive shaft 18. The drive shaft extends downwardly through a bearing assembly 19, and at its lower end, the drive shaft is connected to a drill bit B, having cutters 20 adapted to drill through the earth formation F, in the drilling of a bore hole H. The drive shaft 18 is tubular and has, adjacent its upper end, inlet ports 21, through which the drilling fluid passes from the connecting rod housing 14 into the elongated central bore 22 of the drive shaft, the fluid exiting from the bit B to flush cuttings from the bore hole and cool the bit.

During operation of the fluid motor M, the lower end of the rotor 12 has an eccentric motion which is transmitted to the drive shaft 18 by the universal connecting rod assembly 15, and the drive shaft 18 revolves about a fixed axis within the outer housing structure 23 of the bearing assembly 19, the drive shaft being supported within the housing by bearing means 24 and 25 shown in broken lines in FIG. 1. Such bearing means are well known and take various forms, an example of which is shown in U.S. Pat. No. 4,029,368 granted to Tschirky et al for Radial Bearings.

The bearing assembly of that patent is mud lubricated and a certain amount of the total volume of the circulating fluid is allowed to flow through the bearings, at a rate determined by flow restrictor sleeves, due to the differential pressure caused by the restricted flow of the majority of the circulating or drilling fluid through the bit nozzles, as is well known. The bearings of that patent and all the bearings assemblies of the same general type have set down bearings to transmit axial load from the drill string to the bit, through the drive shaft, and pick-up or off bottom bearings by which the bit is pulled from the hole, when the drill string is pulled.

In the case of the bearings 24 and 25, generally illustrated in FIG. 1, the bearing 24 is a pick up bearing while the bearing 25 is the set down bearing, as will be well understood and as will be more fully described below.

The invention provides a clutch C between an enlarged lower end 26 of the shaft 18 and the lower end of the housing 27 of the bearing assembly 19. In the form shown in FIGS. 1 through 4, the clutch C is normally engaged, but is adapted to be disengaged when drilling fluid is being pumped down the drill pipe string D by the pump P. The clutch includes a drive member 28 and a driven member formed by the lower end of the shaft 18, adapted to be rotatatly driven by rotation of the housing structure, when the clutch is engaged. The drive member 28 is an annular member having a number of circumferentially spaced downwardly projecting lugs or torque transmitting members 29 adapted to interfit with companion, circumferentially spaced lugs or torque transmitting members 30 on the lower end 26 of the drive shaft 18. The drive ring 28 is in torque transmitting and axially shiftable relation to the housing 27 by means of a number of upwardly facing, circumferentially spaced lugs 31 on the drive ring 28 and companion downwardly facing and circumferentially spaced lugs 32 on the lower end of the housing 27. As clearly seen in FIG. 1, the respective torque transmitting members or lugs 29, 30, 31 and 32 have opposing drive surfaces which extend radially and project axially of the assembly, whereby when the clutch is engaged, as seen in FIG. 3, torque can be transmitted in either direction. However, as is well known, it is customary to transmit torque through a drill pipe string in a right-hand direction, which is the direction of make up of the usual threaded connections in the drill pipe string.

The actuator means for the clutch C, in the embodiment of FIGS. 1 through 4, includes an annular actuator body 33, disposed in the inner bore 34, adjacent the lower end of the housing and seating on a upwardly facing shoulder 35 in the housing. The actuator body 33 is suitably keyed to the housing for rotation therewith, as by a suitable number of pins 36 which are engaged at the lower end of the actuator body 33. Preferably, a side ring seal 37 is disposed between the outer periphery of the actuator body 33 and the bore within the body to prevent the bypass of fluid about the exterior of the body, so that fluid flowing downwardly in the housing space between the shaft and the housing 27 is caused to flow through a restricted gap 38, which is defined between the inner periphery 39 of the actuator body 33 and the outer periphery 40 of a sleeve 41 which is keyed at 42 to the shaft 18 for rotation therewith.

The gap 38 between the actuator body 34 and the sleeve 41 is designed to restrict the flow of fluid from the housing, when fluid is being circulated by the pump P, to a relatively small amount, as compared with the gross volume of circulating fluid, the bulk of which flows through the usual bit orifices, causing, during circulation, a pressure differential, which will be later described. The actuator body 33 and the sleeve 41 can be constructed, if desired, according to the above-identified U.S. Pat. No. 4,029,368, to also function as a radial bearing, but in the illustrative embodiment the structure has been shown in a simple form and the gap 38 between the opposing surfaces 39 and 40 has been exaggerated for clarity.

Provided in the actuator body 33 are a suitable number of circumferentially spaced bores or cylinders 43, each containing an acutator piston 44 having a rod 45 extending through the lower end wall of the bearing housing 27 and being threadedly engaged at 46 in the clutch drive ring 28. Above the pistons 44 is a coiled compression spring 47 which normally acts downwardly upon the piston 44, thereby providing a downward force on the clutch drive ring 28, fluid pressure is applied to the piston chamber 48 below the actuator piston 44 from the housing 27 via a passageway 49 , which, at its upper end, is in communication with the housing. On the other hand, fluid in the annular bore hole space externally of the housing is applied to the upper side of the piston 44 through a suitable passageway 50.

The bearing assembly 24 comprises an upper race 51 locked by suitable means 52 on the shaft for rotation therewith, and a lower race 52 is carried within the housing, and has downwardly extending lugs 53 engaging with companion upwardly facing lugs 54 on the upper end of the actuator body 33, whereby the lower bearing race 52 revolves with the housing. Suitable balls or other bearings 55 are disposed between the races, so that as seen in FIG. 2, when the housing structure, including the bearing housing 27 is subjected to an upward pull, thrust is transmitting from the housing to the shaft to the bearing assembly 24, which, in the illustrative embodiment includes a spring or springs 56 shown as a pair of Belvelle springs, disposed between a downwardly facing shoulder 57 on the lower bearing race 52 and an upwardly facing shoulder 58 provided by the actuator body 34, whereby the pick up bearing assembly 54 is spring loaded.

Figure 2:
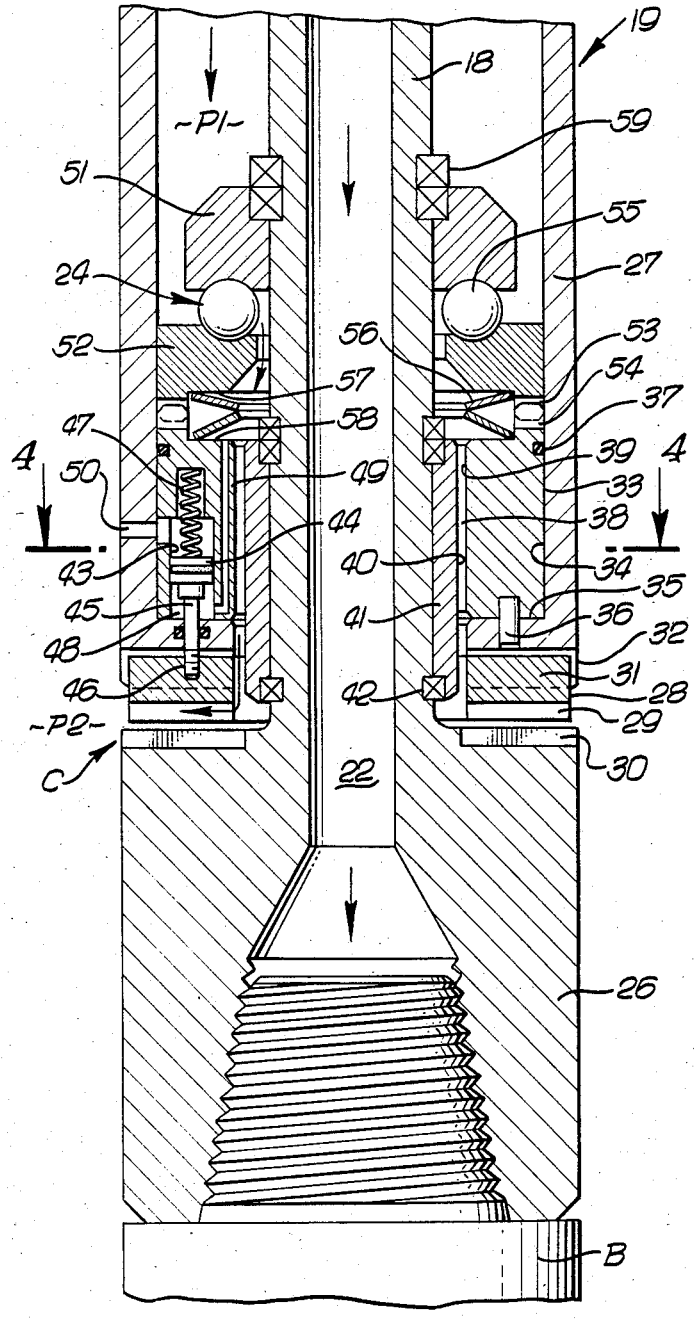
FIG. 2 is an enlarged, fragmentary longitudinal sections as taken on the line 2—2 of FIG. 1 showing one embodiment of the clutch in disengaged condition.
Figure 3:
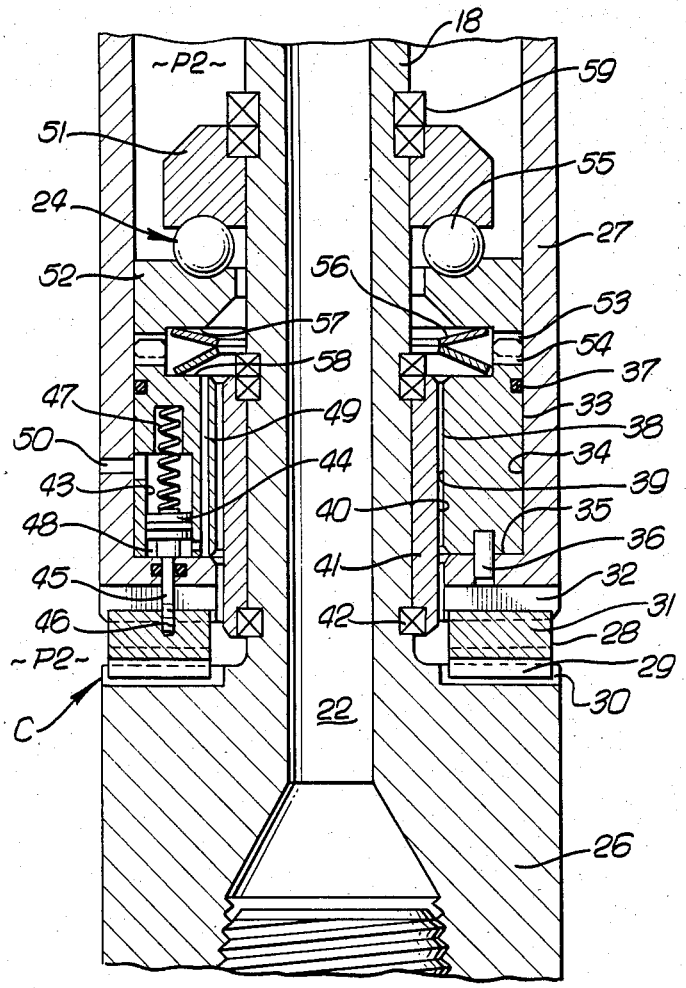
FIG. 3 is a view corresponding with FIG. 2, but showing the clutch engaged.
Figure 4:
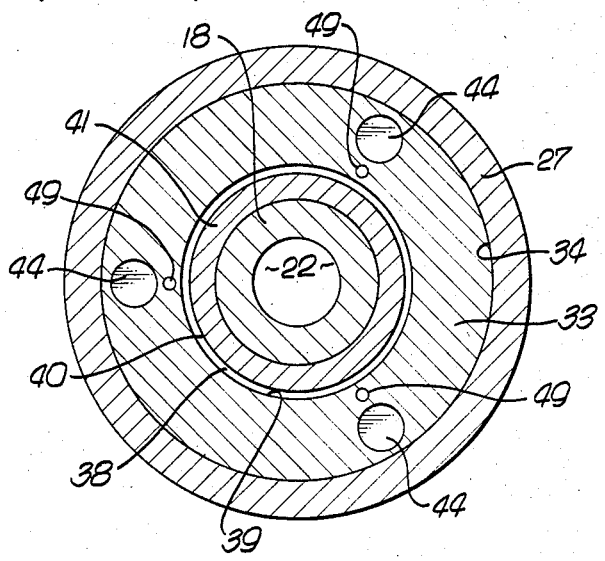
FIG. 4 is a transverse section on the line 4—4 of FIG. 2.

As seen in FIG. 2, and indicated by the arrows, fluid is being pumped downwardly through the bore 22 of the shaft 18, and thus will exit through the bit orifices, causing a pressure differential. The pressure in the housing between the shaft and the housing, which thus flows through the restricted path 38 will be at a pressure P1, while the pressure externally of the housing is at a lower pressure P2, the latter being essentially the hydrostatic pressure of fluid in the annulus, and the former being substantially the same hydrostatic pressure plus the pressure differential caused by the flow restrictors, when the pump is operating. The pressure P1 is applied through the passageway 49 to the underside of the actuator piston 44, urging the actuator piston 44 upwardly, against the downward bias of the spring 47, so that the clutch drive ring 28 will be in the elevated position of FIG. 2, and therefore, the clutch remains disengaged, so long as the pump is operating to circulate fluid through the flow restrictor.

However, when the circulation of fluid downwardly through the flow restrictor is ceased or reduced, the pressure in the housing between the housing and the shaft and externally of the housing are both at hydrostatic pressure P2, at which time the spring 47 can act to positively move the clutch drive ring 28 downwardly, so that the lugs thereon are adapted to interfit with the lugs on the enlarged lower end of the drive shaft 18. In the event that the lugs on the drive ring and on the shaft should not initially interfit, the springs can force the lugs into interfitting engagement upon initial rotative movement of the housing. As will be later described engagement of the clutch C, upon reduction in the flow of drilling fluid conditions the valve V to be opened for continued circulation through the annulus, while the clutch remains engaged.

Figure 5:
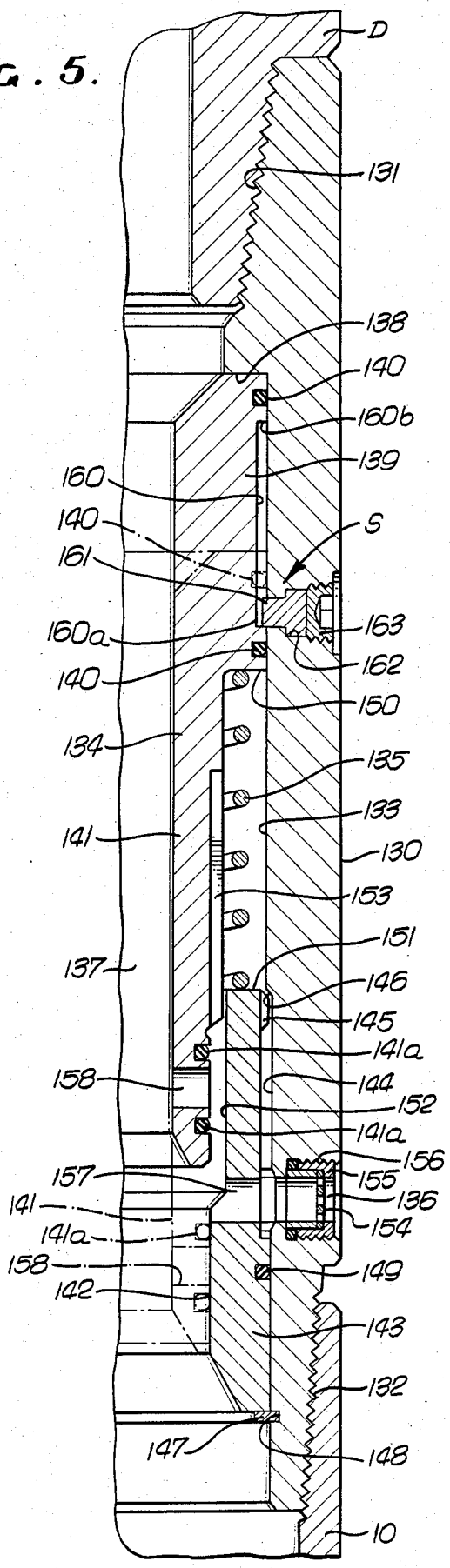
FIG. 5 is an enlarged, fragmentary longitudinal section as taken on the line 5—5 of FIG. 1, showing the circulating valve in an initial open condition in full lines, and showing the valve closed, in broken lines.
Figure 6:
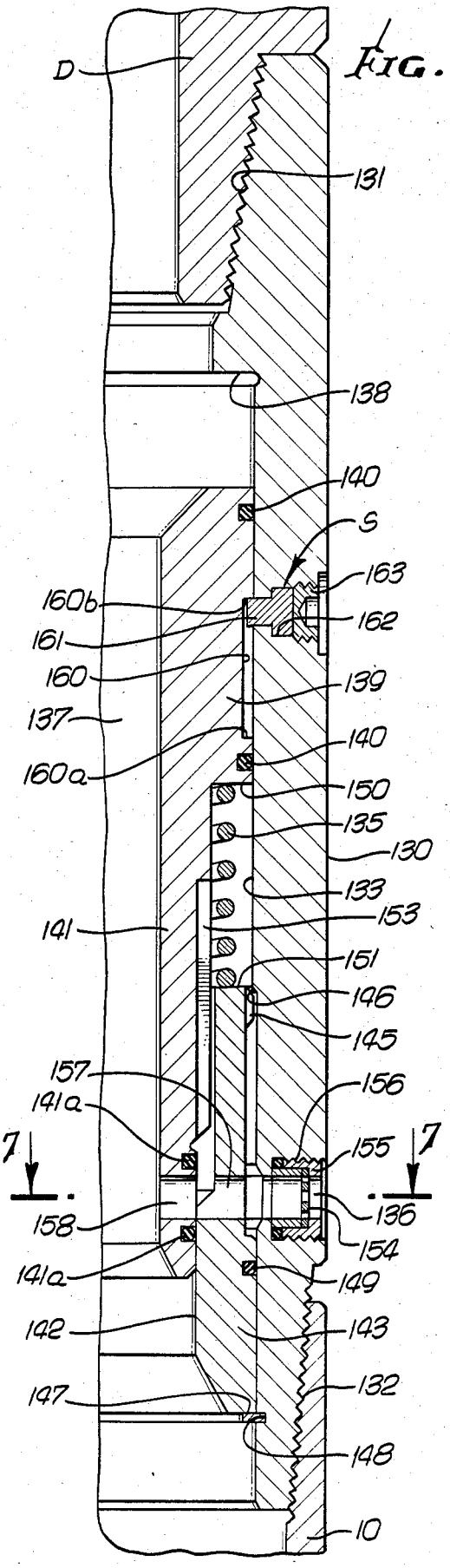
FIG. 6 is a view corresponding with FIG. 5, but showing the by-pass valve in an open condition for circulation.

As best seen in FIG. 3, the drive lugs on the lower end of the housing and on the clutch drive ring remain in engagement when the clutch is engaged with the shaft, so that a positive drive connection exists between the housing and the shaft, without transmitting torque through the rods of the respective actuator pistons. Thus, torque is directly transmitted from the housing to the bit, enabling the housing to be rotated to rotate the bit as an upward pull is being applied to the housing, and through the pick up bearing 24 to the bit, in an effort to release the stuck bit. This is accomplished without adding any weight to the bit, through the housing, and indeed, without changing the load on the bit. When the circulation of fluid is resumed, and if the valve V, later to be described, is not open, the pump pressure is again applied to the hydrostatic pressure in the space between the bearing housing 27 and the shaft, increasing the pressure to the pressure P1, so that the actuator pistons will be actuated upwardly to disengage the clutch. If the bit has been freed, then the flow of fluid through the motor can cause rotation of the bit, but if the bit remains stuck, the pumps can be shut down and the clutch will again re-engage enabling further rotation of the bit by rotation of the drill pipe string, and the valve V, described, can again be opened for circulation through the annulus housing 23 of the bearing assembly 19, the drive shaft being supported within the housing by bearing means generally shown at Referring to the valve V, seen in detail in FIGS. 5 through 8, it is constructed and operable in such a manner that three flow conditions can be established. In FIG. 5 the valve is shown in full lines in one opened condition, establishing communication between the pipe string D and annulus A, enabling fluid to enter to fill the pipe or to exit and drain the pipe, as the assembly is lowered into or pulled from the fluid in the bore hole. In FIG. 5, the valve is shown in broken lines in a position preventing the flow to or from the annulus, and causing the flow of all of the motor fluid from the pipe string to the motor, to drive the rotor and turn the bit. In FIG. 6, the valve is in a second open position, enabling circulation of fluid down the pipe string and upwardly through the annulus, while the motor remains idle, at which time, as pointed out above, the clutch C will be engaged.

The valve assembly comprises an elongated tubular body 130 having an internally threaded box 131 at its upper end, adapted for threaded engagement with the usual threaded pin on the drill pipe string D. At its lower end, the body 130 has an externally threaded pin 132 adapted for threaded engagement in the upper end of the lower housing 10.

Extending longitudinally within the valve body is a bore 133 adapted to reciprocably receive a valve piston sleeve 134. This piston sleeve 134 is normally biased upwardly by a coiled compression spring 135 to the full line position of FIG. 5, so that a number of circumferentially spaced side ports 136 are normally open for communication between the annulus A and the interior of the valve body, and fluid can transfer between the annulus and an elongated fluid passageway 137 which extends through the valve piston sleeve 134. More specifically, the bore 133 of the housing terminates at its upper end at a downwardly facing internal shoulder 138 which forms an upper abutment for the valve piston sleeve 134. On the upper end of the piston sleeve 134 is a piston head 139 having longitudinally spaced side ring or piston ring seals 140 slidably and sealingly engaged within the housing bore 133. Extending downwardly from the piston head 139 is a skirt 141 having adjacent its lower end a pair of circumferentially extended side ring seals 141*a* adapted to be received, as seen in broken lines in FIG. 5, in a sealing bore 142, adjacent the lower end of the valve assembly, so that the side ports 136 will be closed.

To the extent that the valve, as thus far described, includes a valve piston sleeve which is biased to a position opening the side ports by a spring and shifted by the flow of fluid through the valve sleeve to a position closing the side port, the structure is essentially the same as that disclosed in U.S. Pat. No. 3,005,507. The lower sealing bore 142 is provided in a lower stationery sleeve 143 which is installed in an enlarged diameter bore 144 extending upwardly from the lower end of the housing 130. The lower valve sleeve 143 has, at its upper end, a number of circumferentially spaced lugs 145 which confront a downwardly facing shoulder 146, to limit inward movement of the sleeve 143, and the sleeve is retained in the housing by suitable means, such as a resilient snap ring 147 which is installed in a circumferentially extended groove 148 formed adjacent the lower end of the threaded pin 132. A side ring seal 149 is provided about the lower valve sleeve 143 and is sealingly engaged within the reduced bore 144, below the side ports 136. The spaces between the lugs 145, and the annular space between the valve sleeve 143 and the enlarged bore 144 establish communication between the side ports 136 and the space below the valve piston head 139, to prevent fluid entrapment, and the coiled compression spring 135 is disposed in the space below the piston head 39 in seating engagement with the lower surface 150 of the piston head 139 and the upper surface 151 of the lower valve sleeve 143.

The skirt 141 of the shiftable valve sleeve 134 extends slidably into an upper bore 152 of the lower valve sleeve 143, but the outer periphery of the skirt 141 is provided with a suitable number of circumferentially extended slots 153 which also prevent fluid entrapment in the spring chamber.

As is customary in fill or dump valves, the side ports 136 are provided with sceens 154 to prevent the entry of particles of earth formation as fluid is flowing inwardly from the annulus, during lowering of the assembly into the well bore. The screens 154 are in the form of perforated discs mounted in inserts 155 which are threaded, at 156, into threaded bores provided in the valve body at the ports 136.

The lower, stationery valve sleeve 143 has a suitable number of ports 157, spaced circumferentially thereabout and communicating with the body side ports 136, and the shiftable valve sleeve skirt 141 has a suitable number of circumferentially spaced ports 58 between the side ring seals 141. As seen in FIG. 5, in broken lines, when the valve sleeve 134 is shifted downwardly, responsive to the flow of motor fluid through the passage 137, the lower end of the skirt is located below the ports 157 in the lower valve sleeve and the side ports 136 in the body, so that the side ports 136 are effectively closed, and the ports 158 in the skirt 141 of the shiftable valve sleeve 134 are closed within the sealing bore 142 of the lower valve sleeve 143. Under these circumstances, all of the flow of fluid from the pipe string D will be directed through the valve sleeve passage 137 to the fluid motor, so long as the circulation of fluid continues. However, upon cessation of the circulation of fluid, the spring 135 will exert an upward force on the valve sleeve 134 to move the same upwardly.

Figure 7:
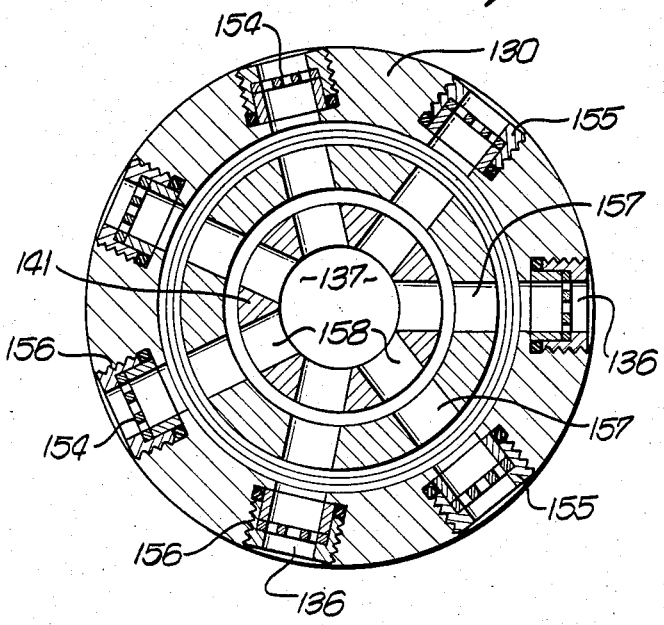
FIG. 7 is a transverse section as taken on the line 7—7 of FIG. 6.

Control slot means S are provided which utilize the downward and upward movement of the valve sleeve 134, within the body 130, to cause the valve sleeve to be limited in its downward movement, during circulation of drilling fluid, following cessation or interruption of circulation, as referred to just above, so that the ports 136, 157 and 158, in the body 130 and the two valve sleeves 134 and 143 are in alignment, as seen in FIG. 7, when circulation is resumed. Accordingly upon resumption of the flow of fluid into the valve assembly, the fluid can by-pass through the aligned ports and can circulate down the pipe string, through the side ports and up the annulus in the well bore. During such circulation the motor can be at rest. Under these conditions, moreover, the clutch will be automatically engaged to enable rotation of the bit by rotation of the pipe string, since pressure is reduced in the piston chambers 48 and the spring 47 can engage the clutch.

In the specific form herein shown, the control means S comprises a continuous cam track or slot 160 and a cam follower or pin 161. The slot 160 is formed in the outer periphery of the piston head 139, while the pin 161 is carried by the valve body 130, and is in the form of a headed pin disposed in a bore 162 in the body and retained in place by a suitable screw plug 163 threaded in the body.

Figure 8:
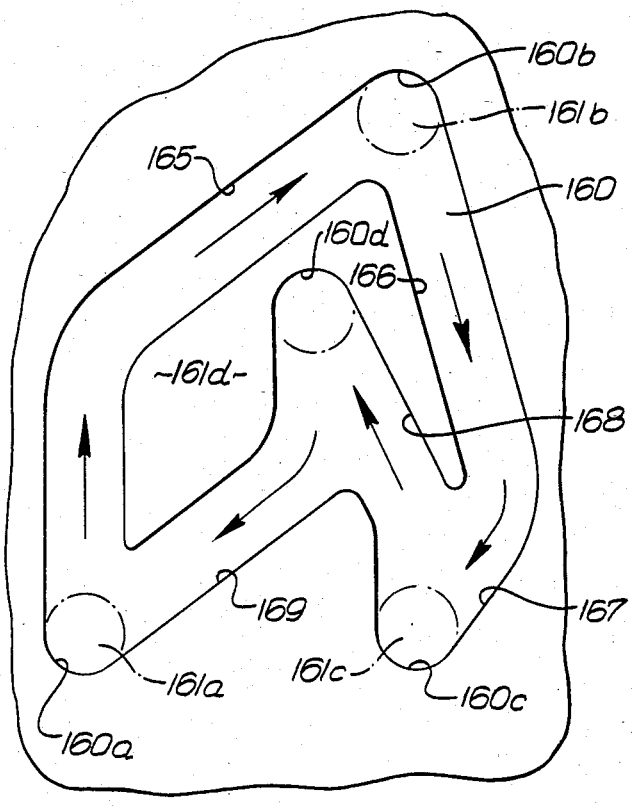
FIG. 8 is a planar projection of the control mechanism for the circulating valve.

The cam slot or track 160 is shown in an expanded or planar projection in FIG. 8. The pin 161 is shown, in this view, in each of its four progressive positions designated 161*a*, 161*b*, 161*c* and 161*d*, and the direction of travel of the pin through the continuous slot is shown by the arrows. The slot has angular walls 165, 166, 167, 168 and 169 which cause the sequential operations described below.

The sequence of operative steps are as follows:

1. When running into the well, the valve is in the full line condition of FIG. 5, with control pin 161 at location 160*a*, and fluid can enter the pipe string. The clutch is engaged, since there is no differential pressure acting on the clutch release pistons, and the open valve prevents fluid from being forced through the motor.
2. Circulation of fluid is commenced, and flow through the valve moves the valve to the closed, broken line position of FIG. 5, compressing the spring. The control pin is then at location 160*b* and all fluid flows to the motor. Fluid pressure acts on the clutch pistons to hold clutch C disengaged.
3. Circulation can be interrupted, and the spring will return the valve to its upper position, placing the pin in location 160*c*; if the pipe is pulled upwardly, the pipe will drain through the open valve. The clutch is also engaged, since there is no differential pressure on the clutch pistons, so that if the bit is stuck it can be rotated by rotation of the running pipe.
4. On resumption of circulation through the valve, it is moved to the position of FIG. 6, and the pin is at location 160*d*, limiting downward movement of the valve to keep the side port open for by-passing the motor and maintaining circulation through the annulus during the time that efforts are made to release the stuck bit. The clutch remains engaged because of the bypass of fluid to the annulus.

5. Another interruption of circulation allows the spring to return the valve to the position of FIG. 5 and the pin will again be at location 160*a*, so that if the bit has been freed, circulation of fluid through the motor provides the pressure differential on the clutch pistons to engage the clutch.

The angular relationship between the ports and the cam slot is such that the ports are radially aligned, as seen in FIG. 7, when in the open contition.

The clutch C and valve V described above have a unique operational dependence, but it is within the purview of the invention that the clutch C be of other specific construction and that the valve V which enables circulation also be of other construction, such as that of the above-identified Tschirky and Crase patent.

Figure 9A:
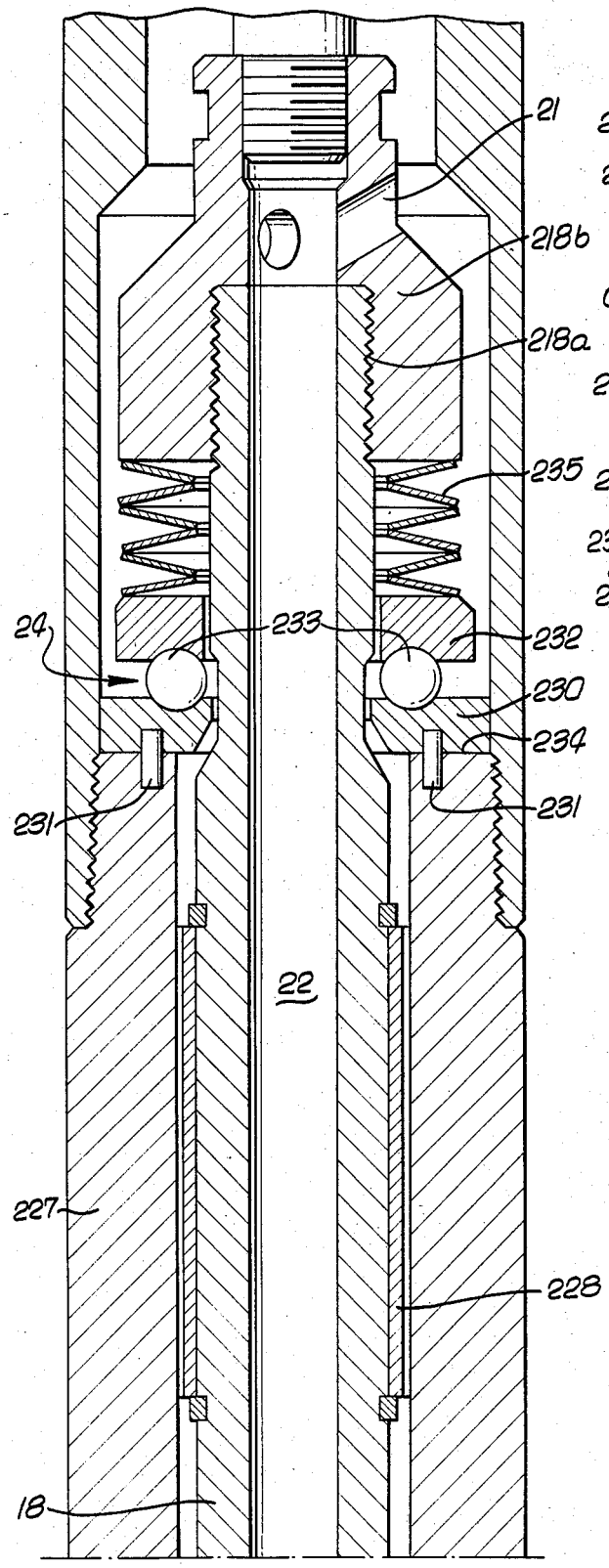
FIGS. 9*a* and 9*b*, together, constitute a longitudinal section through a bearing assembly of an in-hole motor having another form of clutch, the clutch being shown in full lines in the normally disengaged condition, and being shown in broken lines in the engaged condition.
Figure 9B:
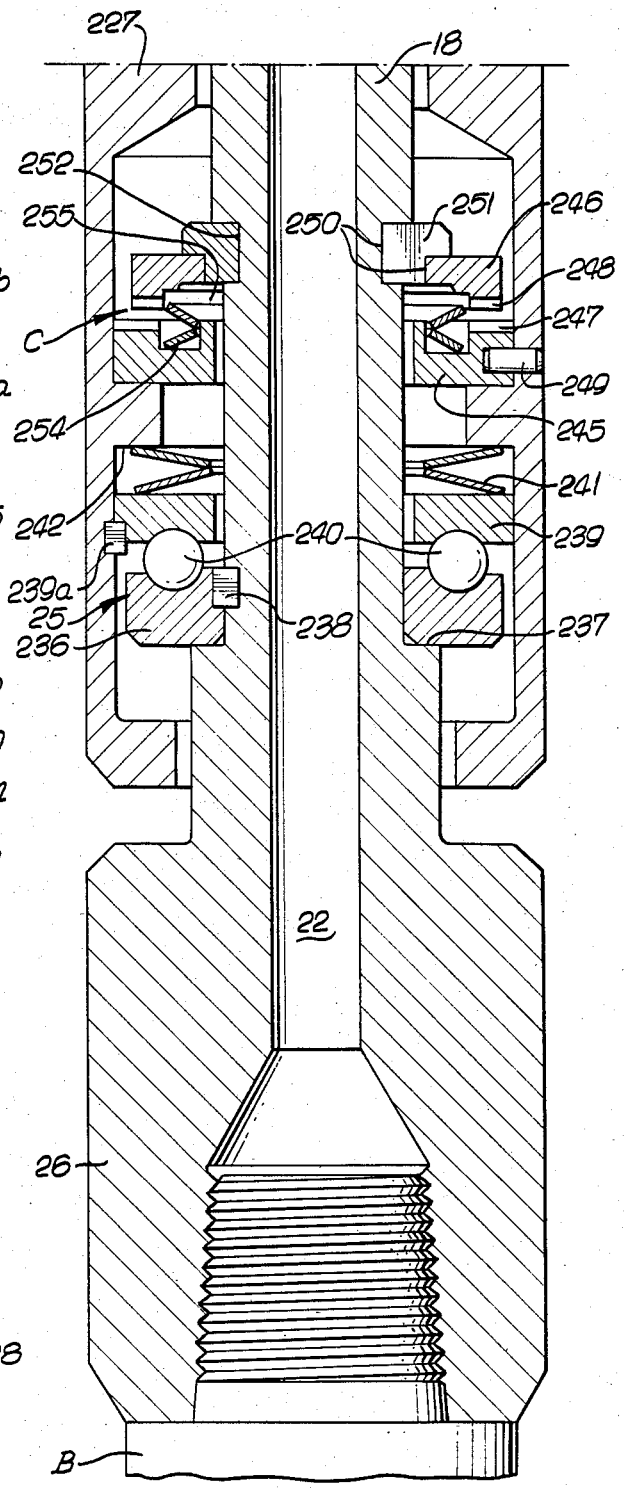

A specific example of another clutch, which is the subject of my companion application Ser. No. 067,882, supra, now U.S. Pat. No. 4,253,532 is shown in FIGS. 9*a* and 9*b*, the clutch C being incorporated in a simple bearing housing in which the shaft is supported by bearings 24 and 25, as in the structure described above.

In the case of the bearings 24 and 25, generally illustrated in FIGS. 9*a* and 9*b*, the bearing means 24 is a pick-up bearing, while the bearing means 25 is the set down bearing, as will be well understood and as will be more fully described below.

The invention provides the clutch C (FIG. 9*b*), between the shaft 18 and the housing 23 of the bearing assembly 19. In this form, the clutch C is normally disengaged, but is adapted to be engaged, if the bit is stuck, when an upward pull is applied to the pipe string D tending to raise the drilling assembly in the bore hole. Upward pull in the pipe D can be augmented by a jarring force applied to the pipe by a jar J of any well known type, such as that made by Bowen Tools, Inc., and illustrated in COMPOSITE CATALOG, Vol. 1, 1976–77, pg. 733, Gulf Publishing Company, Houston, Tex.

It will be seen that the elongated tubular shaft is connected at one end, specifically at its upper end, by a threaded joint 218*a* to a connector cap 218*b* which contains the inlet ports 21 and which connects the upper end of the shaft to the universal joint 17 by a threaded connection. At its other or lower end, the shaft 18 extends from the housing 227 of the bearing assembly, and has an enlarged, lower bit connector 26, to which the threaded pin of the bit B is connected, in the usual manner.

The drilling fluid which is circulated by the pump P, downwardly through the pipe string d and through the motor M, as previously indicated, finds access to the passage 22 through the shaft 18, by the ports 21, and a certain limited portion of the drilling fluid is permitted to flow between the housing and the shaft to lubricate the bearings 24 and 25. Alternatively, it will be understood by those skillled in the art that the bearing assembly may be of a sealed construction. In the illustrative form, the flow of drilling fluid through the bearings of the bearing assembly is restricted by flow restrictor means 228 (FIG. 9*a*) which may also constitute a radial bearing. Such radial bearings are well known and disclosed in the patent granted to Tschirky and Crase on June 14, 1977, U.S. Pat. No. 4,029,368.

As seen in FIG. 9*a*, the drive shaft 18 extends downwardly from the connector cap 218*b*, to which it is connected at its upper end, and projects or extends from the lower end of the housing, for connection to the bit B. The pick-up or off-bottom bearing 24 is seen in FIG. 9*a*, while the set down or drilling bearing 25 is seen in FIG. 9*b*. The bearing 24 includes a lower race 230 pinned or otherwise suitably secured for rotation with the housing 227, as by means of pins 231. Above the lower race 230 is an upper race 232, and bearing balls 233 are disposed in raceways provided in the respective races 230 and 232, whereby thrust is transmitted upwardly, upon upward movement of the housing 227 from an upwardly facing shoulder 234 provided at the upper end of the housing section 27, through the balls 233, to the upper pick-up bearing race 232. A suitable number of Belleville springs 235 are interposed between the upper bearing race 232 and the lower end of the connector cap 218*b*, the Belleville springs 235 constituting a resilient means which maintain a spring load upon the balls 233 and races 230 and 232 during operation of the device in the drilling of the bore hole, whereby the bearing 224 does not run freely.

The Belleville springs 235 are also adapted to enable a certain amount of relative longitudinal movement of the housing with respect to the shaft, in the event that the bit becomes stuck, and an upward pull is applied to the running pipe string D, sufficient to cause engagement of the clutch means C, as will be later described.

Referring to FIG. 9*b*, the set down bearing 25 includes a lower race 236 which seats upon an upwardly facing shoulder 237 on the shaft 18 and which is keyed to the shaft for rotation therewith, as by suitable means such as a key 238. An upper bearing race 239 opposes the lower race 236, and is keyed to the housing at 239*a*, and bearing balls 240 are disposed in raceways provided in the opposing races 236 and 239. In the illustrated form, the drilling or set down bearing 25 is also provided with shock absorbing springs, shown as a set of Belleville springs 241, which engage a downwardly facing shoulder 242 provided in the housing and the upper surface of the upper bearing race 239, whereby to absorb shock during the vertical excursions of the shaft caused by rotation of the bit on the bottom of the bore hole. As previously indicated, such spring loaded bearing assemblies are well known and may take various forms, and the structure herein illustrated is of a simple construction for the purpose of illustrating the capability of the housing to apply a downward drilling thrust and an upward pull to the bit B.

The construction of the set down bearing 25 is not germane to the present invention; nor is the construction of the pick-up bearing 24 germane to the present invention, except to the extent that the Belleville springs 35 be sufficiently resistent to deflection to enable the shaft 18 to be elevated, upon upward movement of the housing 27, to lift the bit B off the bottom of the hole, during off bottom circulation, but being deflectable, in the event that the bit be stuck, to allow sufficient longitudinal movement of the housing 27 of the bearing assembly upwardly with respect to the shaft 18, to cause engagement of the clutch C, without requiring that any additional load be applied to the bit.

Referring to FIG. 9*b*, the clutch C will be seen to comprise a pair of torque transmitting members 245 and 246 having jaw clutch teeth 247 and 248. The clutch member 245 is a ring secured within the housing for rotation therewith, as by suitable pins 249, while the clutch member 246 is a companion ring secured to the shaft 18 by, for example, an eccentric fit 250 with a split thrust collar 251 which is disposed in an eccentric groove 252 provided in the shaft 18, whereby upon assembly, the eccentric relationship of the thrust collar 251 to the shaft, and the eccentric relationship of the clutch ring 246 to the thrust collar 51, prevent relative rotation of the shaft with respect to the clutch ring 246. Clearly, means such as keys or pins, may be employed to connect the clutch ring 46 to the shaft for mutual rotation and for thrust transmission.

As previously indicated, during normal drilling operations, it is desired that the clutch C remain disengaged. This is accomplished during off bottom circulation, by the resistance of the Belleville springs 235 to deflection. The Belleville springs 235, therefore, are selected so that they not only maintain a resilient bias upon the pick-up bearing 224 during drilling operations, but the springs 235 are also sufficiently resistant to deflection to enable the shaft 18 and bit B to be held off bottom, during circulation of drilling fluid, and to maintain the clutch rings 245 and 246 in the axially spaced condition shown in FIG. 9*b*.

However, if the bit B is stuck in the hole, when upward thrust is applied to the bearing housing 27, causing deflection of the springs 235, of the pick-up bearing assembly 24, the springs 235 will allow upward movement of the housing 27 relative to the shaft 18 sufficient to bring the clutch teeth 247 and 248 into engagement. Thereafter, when the clutch rings 245 and 246 are engaged, upward thrust will be transmitted from the clutch ring 245 to the clutch ring 246, at the coengaged transverse surfaces 253, and from the clutch ring 246, through the thrust collar 251, to the shaft 18, so that the upward thrust applied in an effort to release the bit is not applied to the shaft through the pick-up bearing assembly 24.

Furthermore, in the illustrated form, it will be seen that a set of Belleville springs 254 are disposed between the opposing clutch rings 245 and 246, and a clearance space 255 is provided between the upper Belleville spring 254 and an opposing shoulder provided in the upper race 246, so that the Belleville springs 254 are, in effect, inactive, until the upward thrust tending to move the bearing housing 27 upwardly exceeds the resisitance of the pick-up bearing springs 235 and sufficient motion occurs to take up the clearance space 255, at which time the springs 254 are effectively in parallel relationship with the pick-up bearing springs 235. Thereupon, additional upward pull causes further deflection of the pick-up bearing springs 235 and deflection of the clutch springs 254, until the clutch teeth 247 and 248 are coengaged. At this time, the housing and the shaft are interconnected by the clutch means C for mutual rotation.

Accordingly, the rotary table R can be operated to cause rotation of the drill string D and rotation of the housing structure 10, comprising the motor housing 10 and the bearing housing 27, and such rotation can be translated to the bit, through the clutch means C.

The valve V can be opened during efforts to release the bit, enabling circulation up the annulus to prevent settling of cuttings or debris and resultant aggrivation of the problem. If the bit becomes free, the upward force applied by the lines L to the pipe string D can be relaxed, enabling the bit to again be lowered to the bottom of the hole, the valve is reclosed, as the bit is being rotated by the circulation of fluid downwardly through the motor M and through the bit B. Alternatively, the apparatus can be removed from the hole for service or repair.

In the form shown, the pick-up bearing springs 235 enable the necessary clutch engaging longitudinal movement of the housing relative to the shaft, but other structures can be utilized to enable the necessary motion, such as a connection releasable by applied load in excess of the normal load. In the latter case, only the clutch springs 254 need be deflected to cause engagement of the clutch.

From the foregoing, it will be apparent that the present invention provides a novel and simple clutch and valve structure in the in-hole motor bearing assembly, whereby the structure can be connected to the running pipe string, at the well site, and a bit then can be connected to the lower end of the drive shaft, and that if the bit becomes stuck during the drilling operations, the usual inability to rotate the stuck bit by rotation of the pipe string is overcome and circulation can be maintained.

I claim:

1. An in-hole motor apparatus comprising: an in-hole fluid driven motor having a housing adapted to be connected at one end to a running pipe to receive motor fluid, and having a stator, a rotor and shaft rotatable in said housing in response to the flow of fluid through said housing, said shaft extending from the other end of said housing and adapted to be connected to a drill bit, a clutch between said housing and said shaft engageable for connecting said housing and shaft for mutual rotation, and a by-pass valve at said one end of said housing openable to by-pass fluid to the exterior of said housing, said clutch being operable to be disengaged by the pressure of fluid flowing through said motor.

2. An in-hole motor apparatus comprising: an in-hole fluid driven motor having a housing adapted to be connected at one end to a running pipe to receive motor fluid, and having a stator, a rotor and shaft rotatable in said housing in response to the flow of fluid through said housing, said shaft extending from the other end of said housing and adapted to be connected to a drill bit, a clutch between said housing and said shaft engageable for connecting said housing and shaft for mutual rotation, and a by-pass valve at said one end of said housing openable to by-pass fluid to the exterior of said housing, said clutch being operable to be disengaged by the pressure of fluid flowing through said motor, said by-pass valve being operable by the flow of fluid of said motor to be opened allowing engagement of said clutch.

3. An in-hole motor apparatus comprising: an in-hole fluid driven motor having a housing adapted to be connected at one end to a running pipe to receive motor fluid, and having a stator, a rotor and shaft rotatable in said housing in response to the flow of fluid through said housing, said shaft extending from the other end of said housing and adapted to be connected to a drill bit, a clutch between said housing and said shaft engageable for connecting said housing and shaft for mutual rotation, and a by-pass valve at said one end of said housing openable to by-pass fluid to the exterior of said housing, said clutch having an actuator operable by the pressure of fluid flowing through said motor to disengage said clutch, said by-pass valve being normally closed during the flow of fluid through said motor, and including means to open said by-pass valve responsive to the flow of fluid to by-pass said motor.

4. In the method of releasing a stuck bit driven by a fluid driven in-hole motor connected to a running pipe and having a clutch for connecting the running pipe to the bit and a circulation valve for by-passing the fluid above the in-hole motor to the annulus outside of the motor drill, the steps of opening said by-pass valve and circulating fluid through said by-pass valve responsive to said by-pass flow, engaging said clutch to transmit rotation from said running pipe to said bit, wherein said clutch is engaged by reducing the flow of fluid through the motor.

5. In the method of releasing a stuck bit driven by a fluid driven in-hole motor connected to a running pipe and having a clutch for connecting the running pipe to the bit and a circulation valve for by-passing the fluid above the in-hole motor to the annulus outside of the motor drill, the steps of opening said by-pass valve and circulating fluid through said by-pass valve responsive to said by-pass flow, engaging said clutch to transmit rotation from said running pipe to said bit, wherein said clutch is engaged by reducing the flow of fluid through the motor by opening said circulating valve.

6. In the method of releasing a stuck bit driven by a fluid driven in-hole motor connected to a running pipe and having a bit clutch for connecting the running pipe to the bit and a circulation valve for by-passing the fluid above the in-hole motor to the annulus outside of the motor drill, the steps of engaging said clutch to transmit rotation from said running pipe to said bit and opening said circulation valve to by-pass fluid to the annulus, wherein said circulation valve is opened by and said clutch is engaged by ceasing and then resuming the flow of fluid through the running pipe.

* * * * *